United States Patent [19]

Talend

[11] Patent Number: 4,772,224

[45] Date of Patent: Sep. 20, 1988

[54] MODULAR ELECTRICAL CONNECTOR

[75] Inventor: Donald R. Talend, Wauconda, Ill.

[73] Assignee: Corcom, Inc., Libertyville, Ill.

[21] Appl. No.: 92,607

[22] Filed: Sep. 2, 1987

[51] Int. Cl.[4] ..... H01R 13/66

[52] U.S. Cl. ..... 439/607; 439/620

[58] Field of Search ..... 333/181-185, 333/138; 439/607-610, 620

[56] References Cited

U.S. PATENT DOCUMENTS

| | | | |
|---|---|---|---|
| 2,355,182 | 8/1944 | Shoup | 250/20.5 |
| 2,940,058 | 6/1960 | Foster | 333/182 |
| 3,201,698 | 8/1965 | Irelan | 325/477 |
| 3,356,969 | 12/1967 | Przybyszewski | 333/76 |
| 4,020,430 | 4/1977 | Vander Heyden | 439/608 |
| 4,110,696 | 8/1978 | Meeks | 325/480 |
| 4,267,529 | 5/1981 | Brun et al. | 333/185 |
| 4,374,369 | 2/1983 | Sakamoto et al. | 333/182 |
| 4,383,225 | 5/1983 | Mayer | 333/12 |
| 4,486,721 | 12/1984 | Cornelius et al. | 333/1 |
| 4,506,235 | 3/1985 | Mayer | 333/12 |
| 4,519,664 | 5/1985 | Tillotson | 333/12 |
| 4,636,752 | 1/1987 | Saito | 333/12 |
| 4,641,224 | 2/1987 | Reimer | 361/424 |
| 4,656,451 | 4/1987 | Pomponio | 336/96 |
| 4,659,163 | 4/1987 | Althouse et al. | 439/620 |
| 4,673,900 | 6/1987 | Blamire et al. | 333/185 |
| 4,675,629 | 6/1987 | Sakamoto et al. | 333/182 |
| 4,683,450 | 7/1987 | Max et al. | 333/202 |
| 4,695,105 | 9/1987 | Ney et al. | 439/620 |
| 4,695,115 | 9/1987 | Talend | 439/76 |
| 4,698,598 | 10/1987 | Mobley et al. | 329/134 |
| 4,700,155 | 10/1987 | Sakamoto et al. | 333/182 |

OTHER PUBLICATIONS

Interference Control Training Courses Dec., Apr., 1987-1988 Electrical Noise Suppression.

Publication Tokin EMC Interface Cables TSC Series Printed in Japan.

*Primary Examiner*—Gil Weidenfeld

*Assistant Examiner*—Gary F. Paumen

*Attorney, Agent, or Firm*—Hill, Van Santen, Steadman & Simpson

[57] ABSTRACT

A modular jack comprising an insulating body member wherein a plurality of electrical contacts engaged capacitors and which also may be provided with ferrite inductors to produce series inductance.

8 Claims, 1 Drawing Sheet

MODULAR ELECTRICAL CONNECTOR

CROSS-REFERENCES TO RELATED APPLICATIONS

This invention is an improvement on co-pending application Ser. No. 901,824, filed Aug. 29, 1986 now U.S. Pat. No. 4,695,115 which issued on Sept. 22, 1987, entitled "Telephone Connector With ByPass Capacitor" assigned to the assignee of the present invention.

BACKGROUND OF THE INVENTION

1. Field of the Invention

The invention relates in general to electrical contacts and in particular to a novel modular telephone jack in which the contacts are provided with series ferrite inductors. Some embodiments utilize a combination of ferrite inductors and capacitors and some embodiments have a gasket cover.

2. Description of the Prior Art

Standard modular telephone jacks have a number of electrical contacts such as two, six, eight or more which make mating engagement with a male contact which is received therein. The above-referenced related application discloses bypass capacitors to a ground plane from the various contacts.

SUMMARY OF THE INVENTION

It is an object of the present invention to provide a modular jack with bypass capacitors in series with ferrite inductors.

It is another object of the invention to provide a modular jack with bypass capacitors, series ferrite inductors and a gasketed cover.

Yet another object of the invention is to provide a modular jack with series ferrite inductors having no capacitors. The ferrite inductors may take two forms being integrally formed so as to surround all of the contacts or, alternatively, they may take the form of individual cylinders which are formed with central openings through which the conductors extend.

First ends of the capacitors rest against the flexible conductors which act as springs to make electrical contact with first ends of the conductors.

Other objects, features and advantages of the invention will be readily apparent from the following description of certain preferred embodiments taken in conjuntion with the accompanying drawings although variations and modifications may be effected without departing from the spirit and scope of the novel concepts of the disclosure and in which:

DESCRIPTION OF THE PREFERRED EMBODIMENTS

Figure 1:
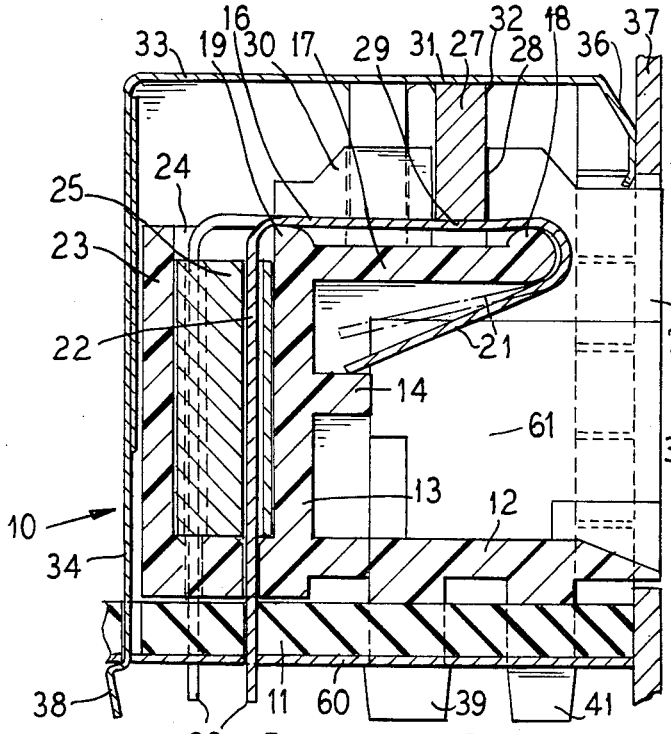
FIG. 1 is a sectional view through the modular connector of the invention.
Figure 4:
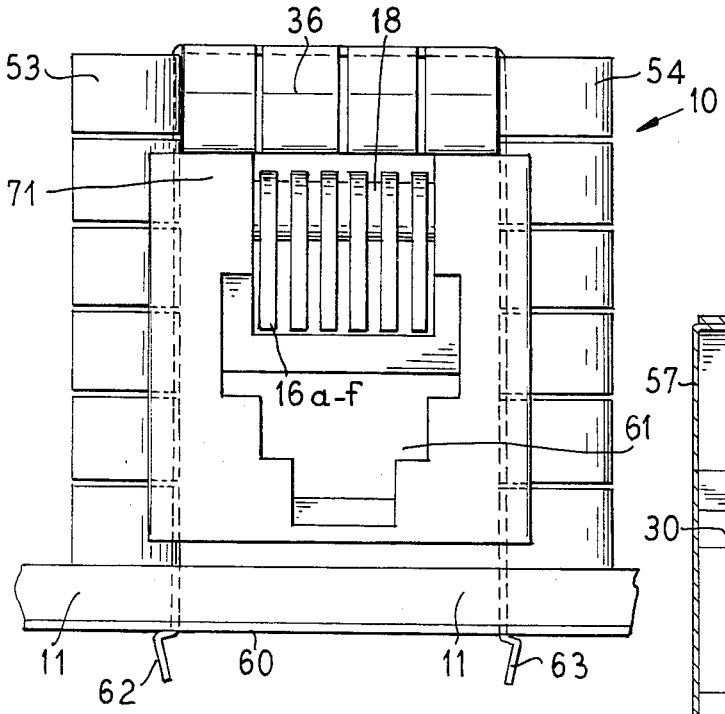
FIG. 4 is a front view of the invention.
Figure 2:
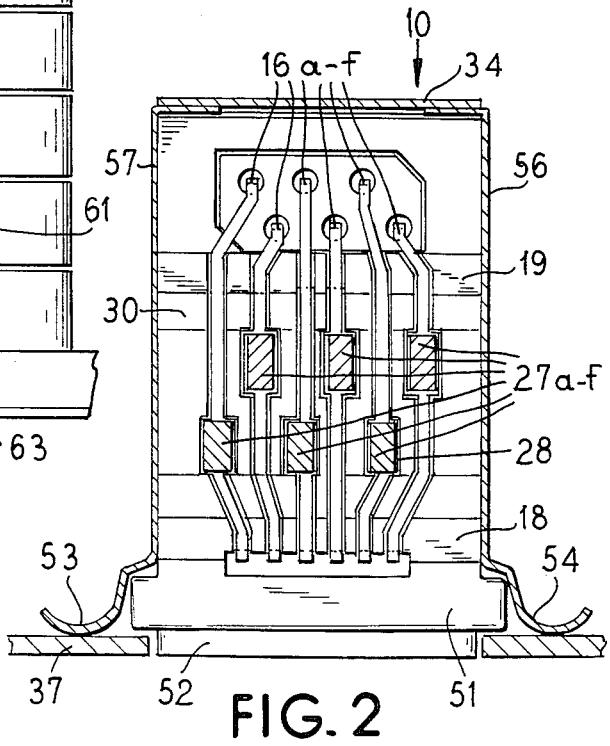
FIG. 2 is a top sectional plan view.

FIGS. 1, 2 and 4 illustrate a first embodiment of the invention which comprises a terminal 10 which can be mounted in a printed circuit board 11 that has printed circuit conductor pass 60 formed thereon. The terminal has a plastic body portion 12 with a front opening 61 into which a male plug can be received as shown in FIG. 4 for example. An upwardly extending plastic portion 13 is connected to the plastic member 12 and has a top portion 17 as shown in FIG. 1. A plurality of electrical conductors 16*a* through 16*f* have first ends 21 which extend into the opening 61 as shown in FIGS. 1 and 4 so that they can make electrical contact with contacts on the male plug which is inserted into the opening 61. The conductors 16 extend over bridge or raised portions 18 and 19 formed in the upper plastic portion 17 such that their portions 29 bridge between the raised portions 18 and 19 and act as springs to make firm electrical contacts with a plurality of parallelepiped-shaped capacitors 27*a* through 27*f* which are received in openings 28 formed in an upper portion 30 of the member 12. As shown in FIG. 2, the conductors 16*a* through 16*f* are offset from each other so as to provide adequate space for the capacitors 27*a* through 27*f* between the bridge portions 18 and 19 of the member 17.

After the conductors 16 pass over the bridge 19, they have portions 22 which extend downwardly through a mass of ferrite inductor material 25 which is integrally formed around the inductor portions 22 and is received in an opening 24 formed in a rear portion 23 of the plastic member 12. The conductors 22 extend through the plastic portion 22 and through openings formed in printed circuit board 60 and are connectible to the electrical circuit path 60 of the printed circuit board by attaching the ends 26*a* through 26*f* to the conductive paths.

A cover member of electrically conductive material encloses the modular connector and provides an electrical grounding path. As shown in FIGS. 1, 2 and 4, the cover member has a top 33, a back 34 and sidewalls 56 and 57 as illustrated in FIG. 2. Flexible tabs 53 and 54 extend from opposite sidewalls 57 and 56 and flexible tabs 36 extend downwardly from the top wall 33 as shown in FIGS. 1 and 4. The connector 10 may be mounted to an electrical conducting plate 37 which is formed with an opening 71 through which the male plug can be inserted into the opening 61 of the connector and the curved tabs 36 engage the ground plane 37 as shown in FIG. 1 and the curved tabs 53 and 54 engage the ground plane 37 about the sidewalls. Thus, the cover member is grounded to the ground plane 37. An alternative grounding arrangement provides a tab 38 which is connected to the rear wall 34 of the cover and extends through an opening in the printed circuit board 11 and which can be connected to a ground conductor on the printed circuit board.

The upper ends of the capacitors 27 are connected to the electrically conducting cover member 33 by solder 32 as shown in FIG. 1 such that the capacitors 27 provide a path between the conductor 16*a* through f and ground through the capacitors 27 and the cover member. Instead of solder electrical continuity can be established between capacitors 27 and members 33 and/or 29 by mechanical means.

As shown in FIG. 1, the lower end of the capacitor 27 bear on the portions of the conductor 16 between the bridge 18 and 19 so as to deflect the conductors downwardly to assure that good electrical contact is made due to the spring tension of the conductors with the lower ends of the capacitors relative to FIG. 1.

The ferrite inductor material 25 also provides loading on the conductors particularly for high frequencies.

Figure 3:
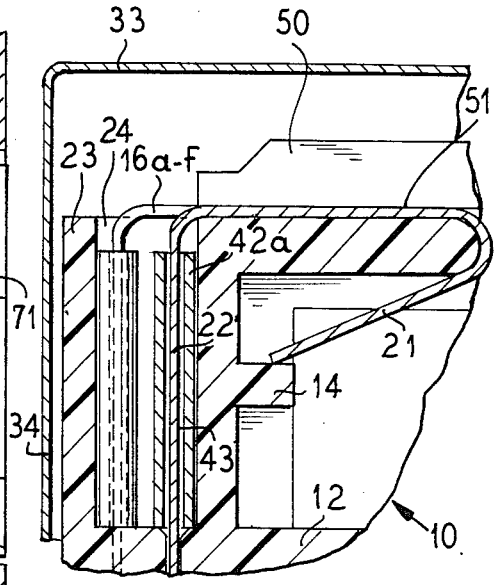
FIG. 3 is an enlarged cut-away view illustrating the inductors.

FIG. 3 illustrates a modification of the invention wherein the capacitors 27 are eliminated and the upper portion 50 of the member 12 is formed with grooves 51 into which the conductors 16*a* through f are received. Individual cylindrical ferrite inductors 42*a* through 42*f* are formed with central openings 43 through which the portions 22 of the conductors 16*a* through 16*f* extend and the individual cylindrical-shaped inductors 42 are placed about each of the conductors 16 during assembly.

The embodiments illustrated in FIGS. 1–4 may also be provided without a cover so as to reduce the size of the connector in the upper portion relative to FIGS. 1 and 3. It is to be noted in FIG. 3 that the capacitors have been eliminated and only the ferrite inductors 42*a* through 42*f* are provided. Also, in the embodiment of FIG. 1, the capacitors 27 may be eliminated and only the ferrite material 25 be utilized.

Thus, it is seen in the present invention that the bottoms of the capacitors are connected to the individual conductors which are depressed under the capacitors due to depressions in the plastic body and the conductors act as springs to make positive contact with the capacitors as well as to allow clearance variation and size in temperature expansion. Both ends of the capacitors may be soldered to the cover member and the conductors if desired. This soldering may be done by heating by induction with solder paste at both ends.

The cover may be formed in two pieces with a top cover which is the ground plane and second portion may be a three sided U-shaped structure joined to the top cover by soldering.

Although the invention has been described with respect to preferred embodiments, it is not to be so limited as changes and modifications can be made which are within the full intended scope of the invention as defined by the appended claims.

I claimed as my invention:

1. A modulator telephone jack comprising an insulating body member formed with an opening for a mating connector, a plurality of electrical contacts mounted in said body member, a plurality of parallelepiped capacitors with first ends in contact, respectively, with said plurality of electrical contacts, an electrically conducting cover member mounted to said body member and engaged by the second ends of said plurality of parallelepiped capacitors, means for grounding said electrically conducting cover member, and ferrite inductor material surrounding said plurality of electrical contacts so as to provide series inductive loading, and wherein said body member is formed with a depression over which said plurality of electrical contacts pass and said first ends of said parallelepiped capacitors engage said electrical contacts over said depression so as to deflect said electrical contacts into said depression.

2. A modular jack according to claim 1 wherein said electrically conducting cover member is soldered to second ends of said plurality of parallelpiped capacitors.

3. A modu1ar jack according to claim 1 including an electrically insulating member formed with a plurality of holes in which said plurality of parallelpiped capacitors are respectively mounted and said insulating member is located between said cover member and said plurality of electrical contacts.

4. A modular jack according to claim 1 including a printed circuit board formed with at least one mounting opening, and said body member formed with at least one mounting prong which is receivable through said mounting opening to attach said modular jack to said printed circuit board and said plurality of electrical contacts to circuit paths on said printed circuit board.

5. A modular jack according to claim 4 including a conductive grounding area on said printed circuit board and at least one electrically conducting tab extending between said conductive grounding area and said electrically conducting cover member.

6. A modular jack according to claim 1 wherein said ferrite material is a unitary mass which surrounds a number of said plurality of electrical contacts.

7. A modular jack according to claim 1 wherein said ferrite material comprises a plurality of discrete inductors which surround said plurality of electrical contacts.

8. A modular jack according to claim 7 wherein said plurality of discrete inductors are cylindrical-shaped and are each formed with an opening through which a respective one of said electrical contacts extend.

* * * * *